US012285129B2

(12) United States Patent
Sire

(10) Patent No.: US 12,285,129 B2
(45) Date of Patent: Apr. 29, 2025

(54) PRONE POSITION SLEEPING PILLOW

(71) Applicant: Trever Sire, River Falls, WI (US)

(72) Inventor: Trever Sire, River Falls, WI (US)

( * ) Notice: Subject to any disclaimer, the term of this patent is extended or adjusted under 35 U.S.C. 154(b) by 560 days.

(21) Appl. No.: 17/498,920

(22) Filed: Oct. 12, 2021

(65) Prior Publication Data

US 2022/0110465 A1 Apr. 14, 2022

Related U.S. Application Data

(60) Provisional application No. 63/091,027, filed on Oct. 13, 2020.

(51) Int. Cl.
*A47G 9/10* (2006.01)

(52) U.S. Cl.
CPC .... *A47G 9/1054* (2013.01); *A47G 2009/1018* (2013.01)

(58) Field of Classification Search
CPC ..... A47G 9/1054; A47G 2009/1018; A47G 9/10; A47G 9/0253; A47G 9/1063; A47G 9/109
See application file for complete search history.

(56) References Cited

U.S. PATENT DOCUMENTS 2,298,218 A 10/1942 Madson
2,779,033 A * 1/1957 Fountain ..... A47G 9/0253 5/490
3,667,074 A 6/1972 Emery
3,900,648 A 8/1975 Smith
4,021,871 A 5/1977 Wortman
4,060,863 A * 12/1977 Craig ..... A47C 20/027 5/636
4,109,332 A 8/1978 Lück
4,118,813 A 10/1978 Armstrong
4,432,110 A 2/1984 Sutton
4,606,088 A 8/1986 Michaelsen et al.
4,754,510 A * 7/1988 King ..... A47C 20/023 D6/601
4,862,539 A 9/1989 Bokich
4,956,886 A 9/1990 Sarzoki
(Continued)

FOREIGN PATENT DOCUMENTS

CN 106419367 A 2/2017
GB 2448126 B 11/2011
WO 9912453 A1 3/1999

OTHER PUBLICATIONS

International Search Report and Written Opinion dated Feb. 7, 2022 for International Application No. PCT/US2021/054473.
(Continued)

*Primary Examiner* — Justin C Mikowski
*Assistant Examiner* — Alison N Labarge
(74) *Attorney, Agent, or Firm* — Seager, Tufte & Wickhem, LLP

(57) ABSTRACT

A pillow has an outer enclosure enclosing a fill. The outer enclosure has a length extending between a first pillow end region that includes a first pillow end, and an opposing second pillow end region that includes an opposing second pillow end. The outer enclosure has a pillow width and a pillow thickness, wherein the pillow width is greater than the pillow thickness at the first pillow end region and the pillow thickness is greater than the pillow width at the opposing second pillow end region.

5 Claims, 16 Drawing Sheets

(56) References Cited

U.S. PATENT DOCUMENTS

| | | | | |
|---|---|---|---|---|
| 4,959,880 | A | 10/1990 | Tesch | |
| 5,732,426 | A | 3/1998 | Furuya et al. | |
| 6,230,350 | B1 | 5/2001 | Goldstein | |
| 6,671,907 | B1 | 1/2004 | Zuberi | |
| 6,698,432 | B2 | 3/2004 | Ek | |
| 6,732,391 | B2 | 5/2004 | George, II | |
| 6,799,343 | B1 | 5/2004 | Pardue | |
| 6,928,678 | B1 | 8/2005 | Chang | |
| 7,003,831 | B1 | 2/2006 | Goutevenier-Reyher | |
| 7,225,917 | B2 | 6/2007 | Uh et al. | |
| 7,310,840 | B2 | 12/2007 | Rubio | |
| 7,322,061 | B2 | 1/2008 | Carroll | |
| 7,461,424 | B2 | 12/2008 | Lindell | |
| 7,546,651 | B2 | 6/2009 | Groteke et al. | |
| 7,581,267 | B2 | 9/2009 | Rubio | |
| 7,594,288 | B1 | 9/2009 | Holliday et al. | |
| 7,793,371 | B1 | 9/2010 | Leach | |
| 7,997,276 | B2 | 8/2011 | Goff | |
| 8,006,335 | B1 | 8/2011 | Andermann | |
| 8,127,385 | B1 | 3/2012 | Goutevenier | |
| 8,448,275 | B1 | 5/2013 | Leach | |
| 8,468,627 | B2 * | 6/2013 | Leach | A47C 20/027 5/652 |
| 8,572,780 | B1 | 11/2013 | Watters | |
| 8,656,537 | B2 * | 2/2014 | Leifermann | A47G 9/0253 5/636 |
| 8,719,982 | B2 | 5/2014 | Kelly | |
| 8,806,684 | B1 | 8/2014 | Ortega et al. | |
| 8,845,388 | B1 | 9/2014 | Dempsey | |
| 9,089,230 | B2 | 7/2015 | Cho | |
| 9,326,906 | B2 | 5/2016 | Thanas | |
| 9,357,864 | B2 | 6/2016 | Campagna | |
| 9,375,104 | B2 | 6/2016 | Abdo | |
| 9,468,319 | B2 | 10/2016 | Wagner | |
| D779,236 | S | 2/2017 | Ribble et al. | |
| 9,943,179 | B1 | 4/2018 | May et al. | |
| 9,974,400 | B2 | 5/2018 | Zuber | |
| 10,080,450 | B2 | 9/2018 | Shin | |
| 10,244,878 | B2 | 4/2019 | Doughty | |
| 10,264,898 | B2 | 4/2019 | Colton | |
| 10,292,509 | B2 | 5/2019 | Wootten, Jr. | |
| D860,685 | S | 9/2019 | Ribble et al. | |
| 10,524,596 | B2 | 1/2020 | Pesale et al. | |
| D894,635 | S * | 9/2020 | Clausse | D6/601 |
| 11,141,010 | B1 * | 10/2021 | Mitchell | A47C 20/027 |
| 11,564,503 | B2 * | 1/2023 | Gregory | A47C 20/023 |
| 2001/0042271 | A1 | 11/2001 | Pearce | |
| 2003/0028969 | A1 | 2/2003 | Rossdeutscher | |
| 2003/0046765 | A1 | 3/2003 | Brown | |
| 2003/0208846 | A1 | 11/2003 | Guarino | |
| 2004/0019972 | A1 | 2/2004 | Schecter et al. | |
| 2004/0068799 | A1 | 4/2004 | Wilson | |
| 2005/0076442 | A1 | 4/2005 | Wassilefky | |
| 2005/0076443 | A1 | 4/2005 | Kruger | |
| 2005/0177945 | A1 | 8/2005 | Chang | |
| 2005/0229314 | A1 | 10/2005 | Chisari | |
| 2006/0248651 | A1 | 11/2006 | Lazakis et al. | |
| 2006/0253986 | A1 | 11/2006 | Rubio | |
| 2007/0209115 | A1 | 9/2007 | Carroll | |
| 2011/0231999 | A1 | 9/2011 | Yang | |
| 2012/0060846 | A1 | 3/2012 | Leoniak et al. | |
| 2012/0085357 | A1 | 4/2012 | Ek | |
| 2013/0031724 | A1 | 2/2013 | Kelly | |
| 2013/0198962 | A1 * | 8/2013 | Melcher | A61G 7/07 5/636 |
| 2013/0205463 | A1 | 8/2013 | Leung et al. | |
| 2013/0326816 | A1 | 12/2013 | Wu | |
| 2014/0096777 | A1 | 4/2014 | Derner | |
| 2014/0144451 | A1 | 5/2014 | Thanas | |
| 2014/0208515 | A1 | 7/2014 | Sramek | |
| 2014/0359947 | A1 | 12/2014 | Turner | |
| 2015/0335507 | A1 | 11/2015 | Emmons et al. | |
| 2016/0073802 | A1 | 3/2016 | Davis, Jr. et al. | |
| 2016/0100701 | A1 | 4/2016 | Mcknight | |
| 2016/0106238 | A1 | 4/2016 | Vargas | |
| 2018/0028352 | A1 | 2/2018 | Randall | |
| 2018/0092475 | A1 | 4/2018 | Victor | |
| 2018/0228306 | A1 | 8/2018 | May et al. | |
| 2018/0317678 | A1 | 11/2018 | Peric | |
| 2019/0116996 | A1 | 4/2019 | Noble | |
| 2019/0200774 | A1 | 7/2019 | Tacon | |
| 2019/0239656 | A1 | 8/2019 | La | |
| 2019/0365124 | A1 | 12/2019 | Verdi | |
| 2020/0000254 | A1 | 1/2020 | Hambartsoumian | |
| 2021/0068561 | A1 * | 3/2021 | Adeeb, Jr. | A47C 7/425 |
| 2021/0235899 | A1 * | 8/2021 | Silva | A47G 9/0253 |

OTHER PUBLICATIONS

Google Search, Shaped Pillows, 21 pages, Accessed Jan. 27, 2020. https://www.google.com/search?q=shaped+pillows&source=lnms&tbm=isch&sa=X&ved=2ahUKEwi8uMeH26TnAhUGVsOKHe3AD6cQ_AUoAnoECAwQBA.

CA Examination Report, Canadian Patent Application No. 3, 195,555, Canadian Patent Office, Sep. 27, 2024 (8 pages).

* cited by examiner

PRONE POSITION SLEEPING PILLOW

RELATED APPLICATIONS

This application claims the benefit of priority under 35 U.S.C. § 119 of U.S. Provisional Application No. 63/091,027 filed Oct. 13, 2020, which application is incorporated by reference herein in its entirety.

TECHNICAL FIELD

The present disclosure relates generally to pillows and more particularly to pillows that allow a prone position sleeper to elevate their head relative to their body.

BACKGROUND

There are a variety of different pillows that are designed to accommodate people who sleep on their back (supine position), people who sleep on their side and people who sleep on their abdomen (prone position). There are also a variety of different pillows that are designed to accommodate various medical ailments that people suffer from. Some of these pillow designs are quite elaborate, and can be larger than a standard pillow and difficult to manufacture. What would be desirable is a pillow that is relatively easy to manufacture, can be made to utilize a standard pillow case, and can provide some relief for prone position sleepers who would like to elevate their head relative to their body.

SUMMARY

The present disclosure relates generally to pillows and more particularly to pillows that allow a prone position sleeper to elevate their head relative to their body. In some instances, pillows of the present disclosure can be relatively easy to manufacture and can be made to utilize a standard pillow case.

In an example, a pillow includes an outer enclosure enclosing a fill. The outer enclosure has a length extending between a first pillow end region that includes a first pillow end, and an opposing second pillow end region that includes an opposing second pillow end. The outer enclosure has a pillow width and a pillow thickness, wherein the pillow width is greater than the pillow thickness at the first pillow end region and the pillow thickness is greater than the pillow width at the opposing second pillow end region.

In another example, a pillow includes a first pillow end and a second pillow end that is opposite to the first pillow end. A pillow length extends between the first pillow end and the second pillow end. The pillow has a pillow width that is perpendicular to the pillow length and a pillow thickness that is perpendicular to the pillow length and is perpendicular to the pillow width. In this example, the pillow width is greater than the pillow thickness at the first pillow end and the pillow thickness is greater than the pillow width at the second pillow end.

In another example, a pillow includes an outer enclosure enclosing a fill. The outer enclosure includes a body with a first end region defining a torso support region and an opposing head support region, the head support region defining a first head support region on a left side of the head support region and a second head support region on a right side of the head support region, the torso support region and the head support region each having a major dimension and an orthogonal minor dimension. The torso support region extends between two corresponding opposing lateral sides of the outer enclosure along the major dimension of the torso support region and between two corresponding opposing lateral sides of the outer enclosure along the minor dimension of the torso support region. The head support region extends between two corresponding opposing lateral sides of the outer enclosure along the major dimension of the head support region and between two corresponding opposing lateral sides of the outer enclosure along the minor dimension of the head support region. The major dimension of the torso support region is radially offset relative to the major dimension of the head support region when the pillow is in a relaxed state.

In another example, a pillow has an outer enclosure enclosing a fill. The outer enclosure includes a top sheet and a bottom sheet. For convenience, the present disclosure uses relative terms such as top, bottom, left, right, front, back, upper, lower, up, down, horizontal, vertical, and/or others. It is to be understood that these terms are merely used for illustrative purposes and are not meant to be limiting in any manner. The top sheet joins the bottom sheet along a first end of the pillow to form an elongated first tapered edge that extends from a left side of the outer enclosure to a right side of the outer enclosure. The top sheet joins the bottom sheet along a second opposing end of the pillow to form an elongated second tapered edge that is nonparallel with the elongated first tapered edge.

In another example, a pillow includes a first end that is tapered to define an elongated horizontal tapered edge to provide a tapered torso support region. The pillow includes a second opposing end that is tapered to define an elongated vertical tapered edge that is offset from, substantially perpendicular to, and generally aligned with a mid-point of the elongated horizontal tapered edge. The second opposing end of the pillow is configured to provide a first head support region on a left side of the elongated second tapered edge and to provide a second head support region on a right side of the elongated second tapered edge.

An example method of making a pillow includes closing a first end of an outer enclosure to define an elongated horizontal tapered edge. Provide a fill through a second opposing end of an outer enclosure. Close a second end of the outer enclosure to define an elongated vertical tapered edge that is substantially perpendicular to the elongated horizontal tapered edge.

The preceding summary is provided to facilitate an understanding of some of the innovative features unique to the present disclosure and is not intended to be a full description. A full appreciation of the disclosure can be gained by taking the entire specification, claims, figures, and abstract as a whole.

BRIEF DESCRIPTION OF THE FIGURES

The disclosure may be more completely understood in consideration of the following description of various examples in connection with the accompanying drawings, in which.

Figure 1:
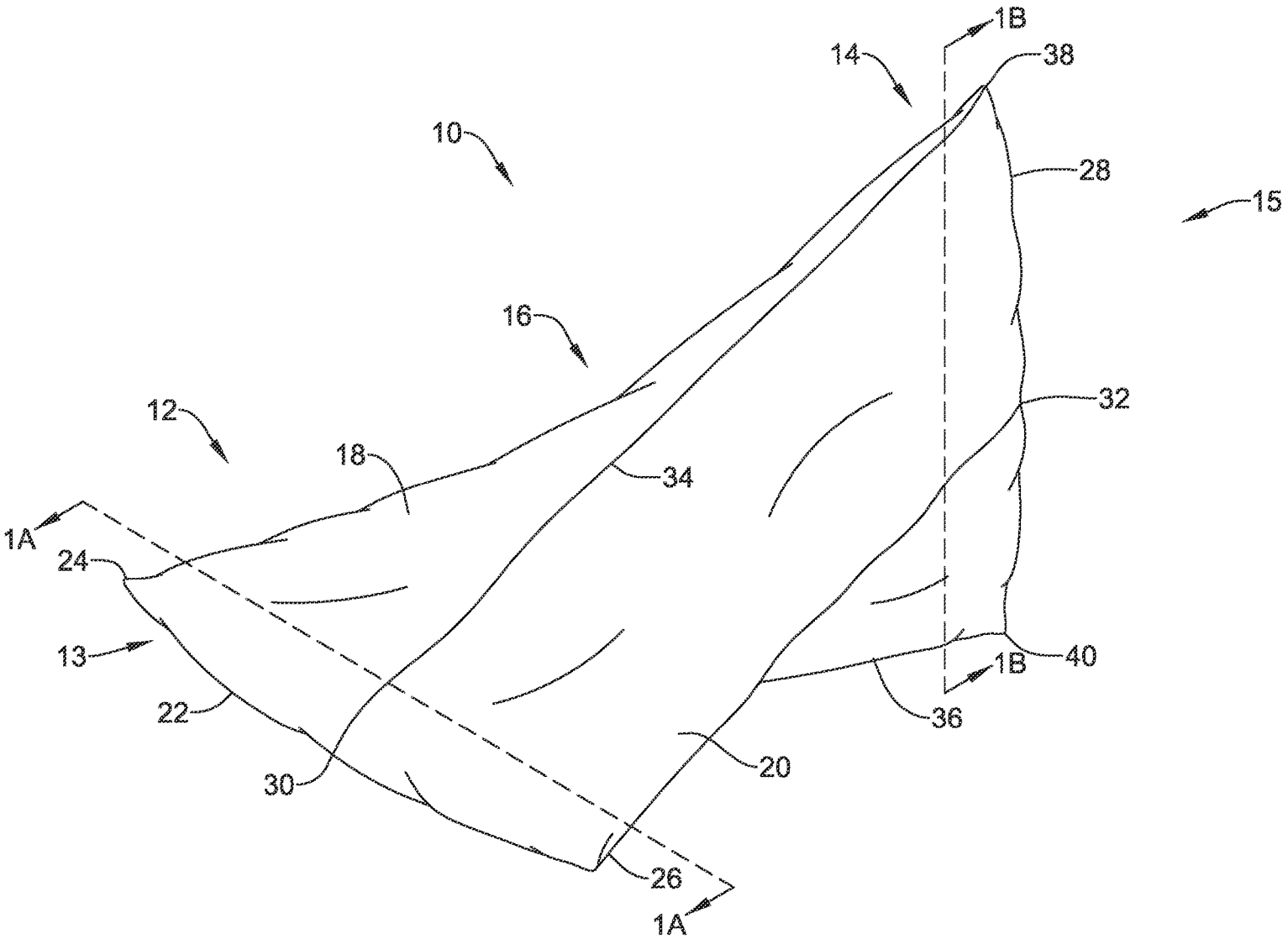
FIG. 1 is a perspective view of an illustrative pillow.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

DESCRIPTION

The following description should be read with reference to the drawings, in which like elements in different drawings are numbered in like fashion. The drawings, which are not necessarily to scale, depict examples that are not intended to limit the scope of the disclosure. Although examples are illustrated for the various elements, those skilled in the art will recognize that many of the examples provided have suitable alternatives that may be utilized.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

For convenience, the present disclosure uses relative terms such as top, bottom, left, right, front, back, upper, lower, up, down, horizontal, vertical, and/or others. It is to be understood that these terms are merely used for illustrative purposes and are not meant to be limiting in any manner.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic is described in connection with an embodiment, it is contemplated that the feature, structure, or characteristic may be applied to other embodiments whether or not explicitly described unless clearly stated to the contrary.

Figure 2:
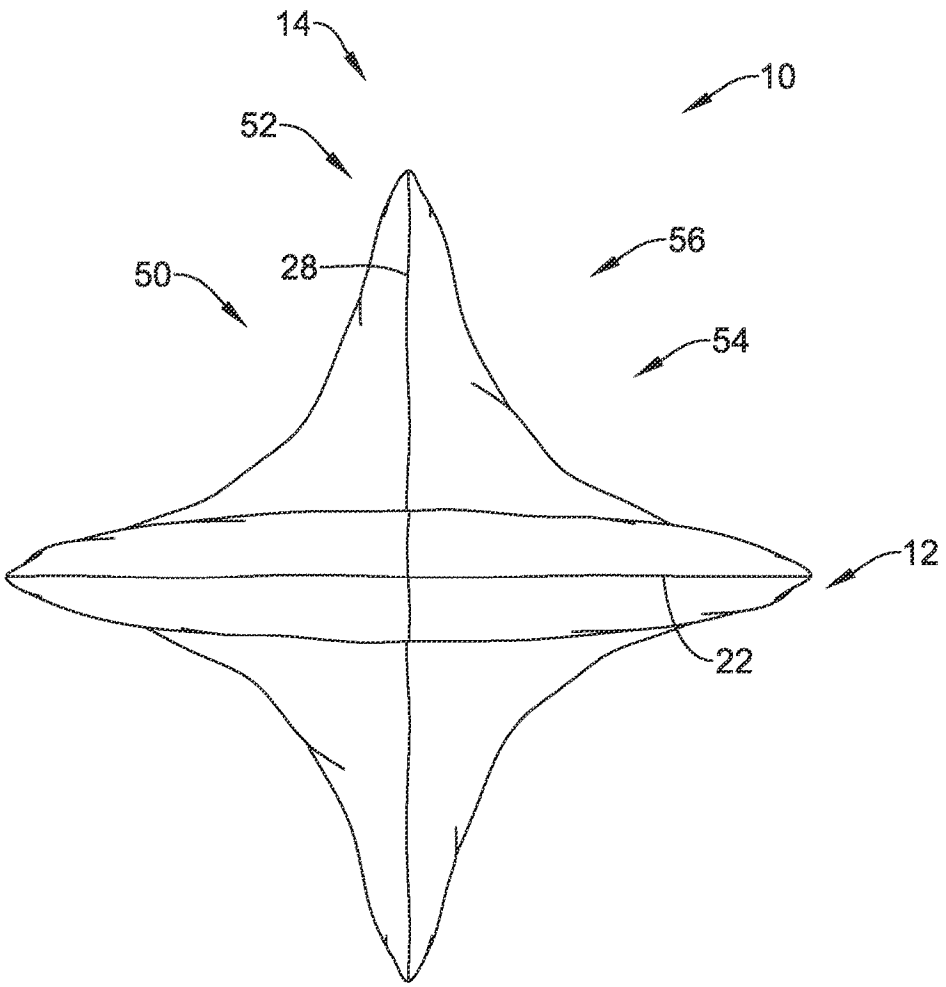
FIG. 2 is an end view of the illustrative pillow of FIG. 1.
Figure 3:
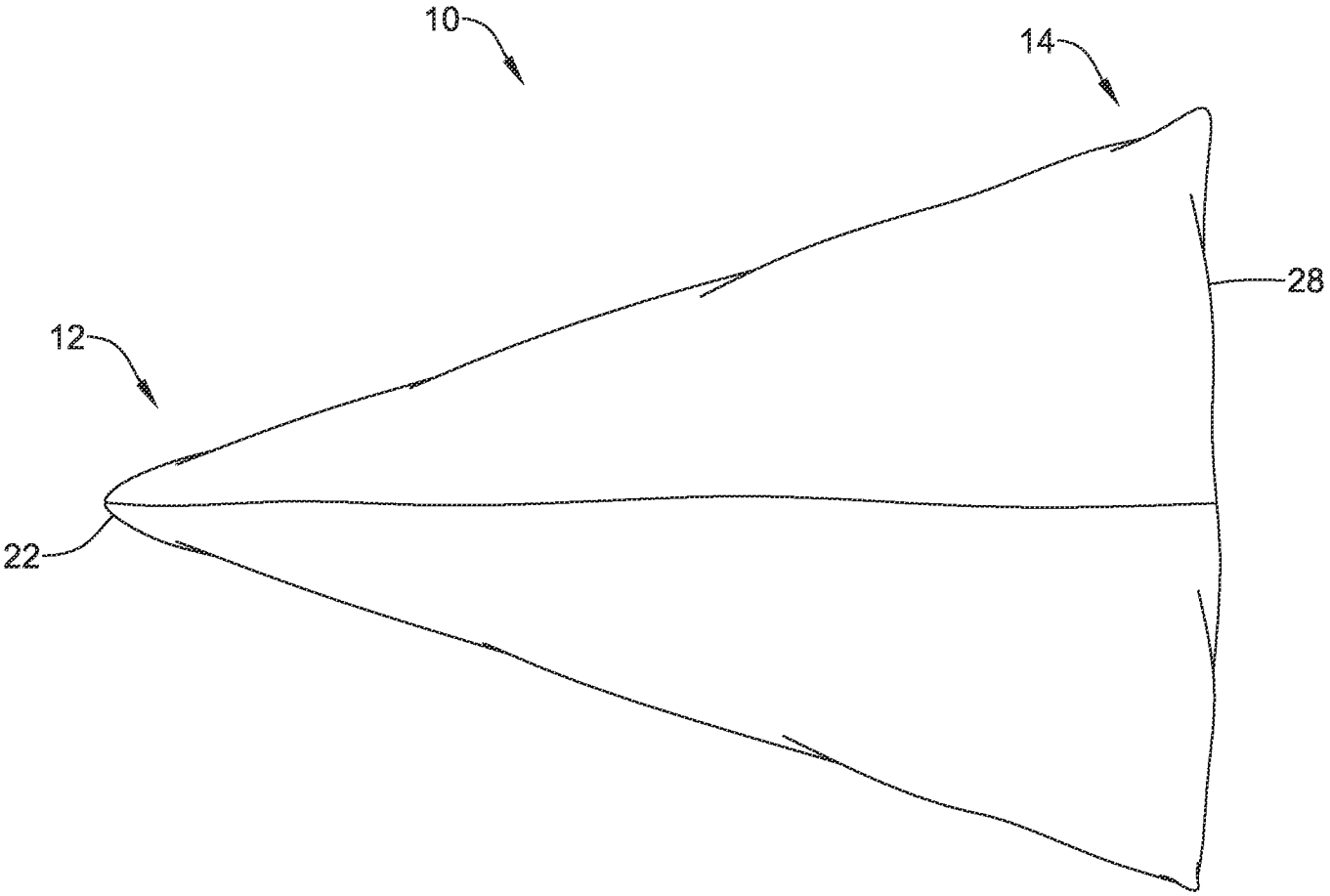
FIG. 3 is a side view of the illustrative pillow of FIG. 1.

FIG. 1 is a perspective view of an illustrative pillow 10. FIG. 2 is an end view of the illustrative pillow 10, and FIG. 3 is a side view of the illustrative pillow 10. In some instances, the illustrative pillow 10 may be considered as being useful for aiding people with particular maladies when they sleep in a prone position. For example, the illustrative pillow 10 may be useful for prone-position sleepers who suffer from heartburn, or acid reflux. In some instances, acid reflux can also be referred to as gastroesophageal reflux disease, or GERD. GERD is a long-term condition in which stomach acid comes up into the esophagus. Individuals who suffer from acid reflux or GERD can find relief by sleeping with their head elevated relative to their torso, which can be complicated for those who prefer to sleep on their stomach, in what is known as a prone position. In some cases, the illustrative pillow 10 may also be useful for individuals who suffer from sleep apnea. Sleep apnea is a condition in which a person periodically stops breathing, and then wakes up to cause breathing to resume. In some instances, sleeping in a prone position may assist with sleep apnea, as the person's jaw may not slump as much in response to gravity. It is contemplated that the illustrative pillow 10 may assist in reducing the tendency (or intensity) of snoring in individuals who have a tendency to snore.

In broad terms, the illustrative pillow 10 of FIG. 1 includes a tapered torso support region 12 that may be considered as being more horizontal in profile and a head support region 14 that may be considered as being more vertical relative to the tapered torso support region 12. The tapered torso support region 12 may be considered as being disposed relative to a first end 13 of the pillow 10 and the head support region 14 may be considered as being disposed relative to a second end 15 of the pillow 10. In some cases, it will be appreciated that which end of the pillow 10 forms the tapered torso support region 12 and which end of the pillow 10 forms the more vertically-oriented head support region 14 can depend on the relative orientation of the pillow 10 relative to a sleeper. In the illustrated orientation, the tapered torso support region 12 is to the left and the head support region 14 is to the right. If one were to flip the pillow end-for-end, and rotate the pillow 10 a quarter turn along a longitudinal axis, what is currently labeled as the tapered torso support region 12 would be to the right, and would form a more vertically-oriented head support region, and what is currently labeled as the head support region 14 would be to the left, and would form a tapered torso support region.

The illustrative pillow 10 may be considered as including an outer enclosure 16 that encloses a fill. The outer enclosure 16 may be formed of any suitable material. Illustrative but non-limiting examples of suitable materials for forming the outer enclosure 16 include fabrics such as cotton, synthetic materials and blends of cotton and synthetic materials. These are only illustrative. The outer enclosure 16 extends from the first end 13 of the pillow 10 to the second end 15 of the pillow 10. The fill is not expressly illustrated in FIG. 1 because it is encompassed within the outer enclosure 16.

In some cases, the outer enclosure 16 may be considered as including a top sheet 18 and a bottom sheet 20. It will be appreciated that what appears to be the top and what appears to be the bottom is dependent upon the particular orientation of the pillow 10. The top sheet 18 joins the bottom sheet 20 to form an elongated first tapered edge 22 that extends from a left side 24 of the outer enclosure 16 to a right side 26 of the outer enclosure 16. The top sheet 18 joins the bottom sheet 20 at an opposing end of the pillow 10 to form an elongated second tapered edge 28 that is non-parallel with the elongated first tapered edge 22. In some cases, the top sheet 18 and the bottom sheet 20 may be part of a single piece of fabric. In some cases, the top sheet 18 and the bottom sheet 20 may be part of a single piece of fabric, folded over on itself to provide the top sheet 18 and the bottom sheet 20. These are just examples.

In some cases, the elongated first tapered edge 22 and/or the elongated second tapered edge 28 may provide a sharply tapered edge of the pillow 10 that tapers to almost an edge. It will be appreciated that how the pillow 10 is filled may alter the appearance of the elongated first tapered edge 22 and/or the elongated second tapered edge 28. In some cases, for example, the elongated first tapered edge 22 and/or the elongated second tapered edge 28 may have a softer or even a substantially softer profile, depending on the type and quantity of fill disposed within the pillow 10. In some cases, the shape of the elongated first tapered edge 22 and/or the shape of the elongated second tapered edge 28 may vary somewhat from pillow to pillow, depending on exactly how seams are sewn together to form the pillow 10 and/or how the fill is distributed within the pillow.

In some instances, the elongated second tapered edge 28 is substantially perpendicular to the elongated first tapered edge 22. Substantially perpendicular may be defined as being, for example, within plus or minus 30 degrees from perpendicular, within plus or minus 20 degrees from perpendicular, within plus or minus 10 degrees from perpendicular, or within plus or minus 5 degrees from perpendicular. These are just examples. In this, it will be appreciated that the pillow 10 is easily deformable, and the elongated first tapered edge 22 could be moved toward the elongated second tapered edge 28, or that the pillow 10 may be deformed in a variety of different ways. By saying that the elongated second tapered edge 28 is substantially perpendicular to the elongated first tapered edge 22, this refers to a configuration in which the pillow 10 is not actively deformed, such as in a default, relaxed or manufactured state.

In some cases, the elongated second tapered edge 28 may be considered as being laterally offset from but generally aligned with a mid-point 30 of the elongated first tapered edge 22. In some cases, the elongated first tapered edge 22 may be considered as being laterally offset from but generally aligned with a mid-point 32 of the elongated second tapered edge 28. In some cases, generally aligned with the mid-point 32 of the elongated second tapered edge 28 means that the elongated first tapered edge 22 is aligned within 30 percent of the length of the elongated first tapered edge 22 from the mid-point 32, within 20 percent of the length of the elongated first tapered edge 22 from the mid-point 32 or within 10 percent of the length of the elongated first tapered edge 22 from the mid-point 32. These are just examples.

The illustrative pillow 10 of FIG. 1 includes a first side seam 34 and a second side seam 36 that together with the elongated first tapered edge 22 and the elongated second tapered edge 28 complete the enclosure 16. As illustrated, the first side seam 34 extends from the mid-point 30 of the elongated first tapered edge 22 to a first end 38 of the elongated second tapered edge 28. The second side seam 36 extends from the mid-point 30 of the elongated first tapered edge 22 to a second end 40 of the elongated second tapered edge 28. In some cases, there may be only one side seam, such as when the top sheet 18 and bottom sheet 20 are formed from one piece of fabric having left and right sides, wherein the left side is folded over to the right side and sewn to form the single side seam of the pillow. In some cases, there may be no side seam, such as when the top sheet 18 and bottom sheet 20 are formed from a single piece of material. In some cases, the single piece of material may be configured as a lay flat flexible tube with open ends. In one example, a lay flat flexible tube may be made from a poly material that is extruded into a continuous lay flat tube that is then cut to length for each pillow. In another example, a lay flat flexible tube may be made by a knitting process, in a similar way that an infinity scarf is made. These are just examples.

In some cases, the top sheet 18 is sewn to the bottom sheet 20 along the first end 13 of the pillow 10 to form the elongated first tapered edge 22, and the top sheet 18 is sewn to the bottom sheet 20 along the second end 15 of the pillow 10 to form the elongated second tapered edge 28. In some cases, the top sheet 18 and the bottom sheet 20 are sewn together along the first side seam 34 and/or along the second side seam 36. If the top sheet 18 and the bottom sheet 20 are separate pieces of fabric, then the top sheet 18 and the bottom sheet 20 may be sewn together along both the first side seam 34 and the second side seam 36. However, if the top sheet 18 and the bottom sheet 20 are formed from a common sheet that is folded in half, it will be appreciated that the fold in the fabric would form one of the elongated first tapered edge 22, the elongated second tapered edge 28, the first side seam 34 or the second side seam 36, depending on the direction in which the common sheet was folded. In some cases, one or more of the elongated first tapered edge 22, the elongated second tapered edge 28, the first side seam 34 or the second side seam 36 may be sewn seams. In some cases, one or more of the elongated first tapered edge 22, the elongated second tapered edge 28, the first side seam 34 or the second side seam 36 may include zippers. In some cases, one or more of the elongated first tapered edge 22, the elongated second tapered edge 28, the first side seam 34 or the second side seam 36 may be joined together with an adhesive, clips, buttons and/or in any other suitable way.

In some instances, the elongated first tapered edge 22 has a first length and the elongated second tapered edge 28 has a second length in a relaxed state. The first length may, for example, be within 50 percent of the second length, within 40 percent of the second length, within 30 percent of the second length, within 20 percent of the second length, within 10 percent of the second length, or within 5 percent of the second length. These are just examples.

In order for the pillow 10 to fit into a commercially available pillow case, the pillow 10 may have particular dimensions. For example, a Standard-sized pillow is 20 inches by 26 inches (51 centimeters (cm) by 56 cm). A Queen-sized pillow is 20 inches (51 cm) by 30 inches (76 cm). A King-sized pillow is 20 inches (51 cm) by 36 inches (92 cm). In some cases, a body pillow may have dimensions of 20 inches (51 cm) by 54 inches (137 cm). These are just examples, and pillow sizes may vary a bit relative to these standards. The first length of the elongated first tapered edge 22 as well as the second length of the elongated second tapered edge 28 may be selected in accordance with these measurements, such that the pillow 10 can fit into a pillow case that is designed to fit one or more of these pillow standards. Similarly, the first side seam 34 and the second side seam 36 may also be chosen accordingly. Having the pillow fit a standard sized pillow case may allow the pillow to match the design aesthetics of the other pillows, sheets, blankets and/or other bedding materials, and better blend in with the existing décor.

Figure 1B:
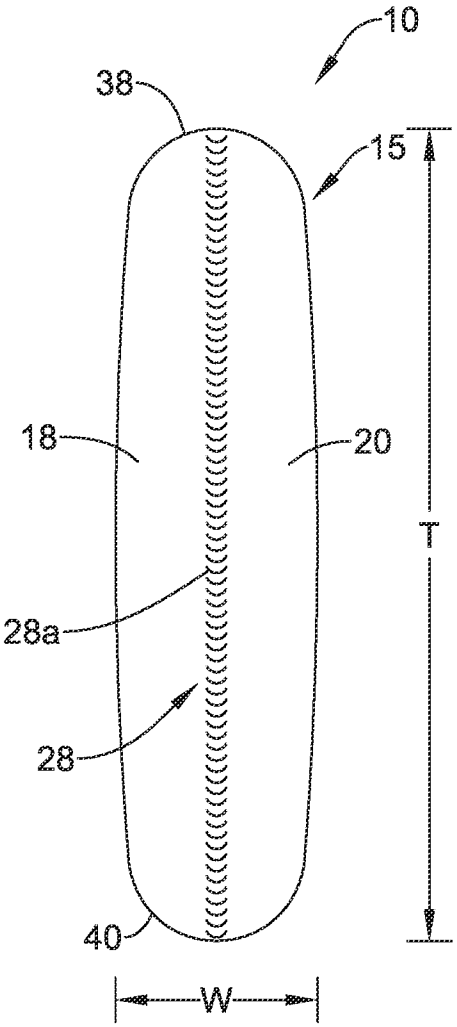
FIG. 1B is a cross-sectional view taken along the line 1B-1B of FIG. 1 looking toward an opposing second end of the pillow.
Figure 1A:
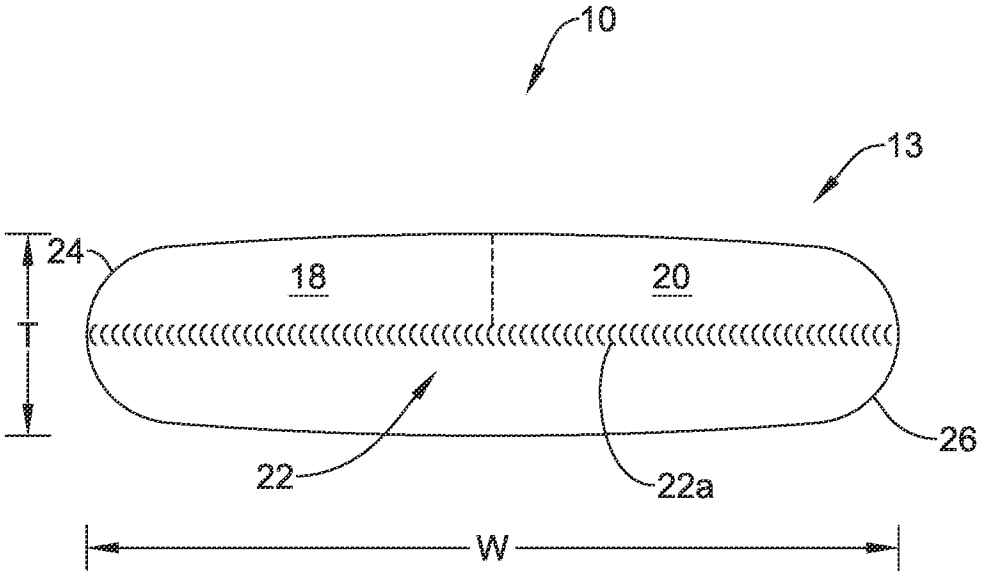
FIG. 1A is a cross-sectional view taken along the line 1A-1A of FIG. 1 looking toward a first end of the pillow.

FIG. 1A is a cross-sectional view of the pillow 10 taken along the line 1A-1A of FIG. 1 looking toward the first tapered edge 22 of the pillow 10, and FIG. 1B is a cross-sectional view of the pillow 10 taken along the line 1B-1B of FIG. 1 looking toward the elongated second tapered edge 28 of the pillow 10. FIGS. 1A and 1B are shown with the fill removed. Taken together, these cross-sectional views help illustrate how the pillow 10 provides the torso support region 12 that may be considered as having more of a horizontal orientation and the head support region 14 that may be considered as having more of a vertical orientation. It will be appreciated that the exact shape of these two cross-sectional views should be considered as being representative of the pillow 10 in a relaxed state, as the exact shape will depend on the fill that is placed within the pillow 10 and on external forces exerted on the pillow 10.

As shown, the pillow 10 has a width "W" and a thickness "T" in the relaxed state. In this, width may be considered as a dimension across the end of the pillow 10 that is parallel or substantially parallel with a surface on which the pillow 10 will be used, such as on a bed. Thickness may be considered as a dimension that is perpendicular or substantially perpendicular to the width, and perpendicular or substantially perpendicular to the surface on which the pillow 10 will be used. As can be seen in the cross-sectional view shown in FIG. 1A, which represents the torso support region 12, the pillow 10 in this region has a width "W" that is substantially greater than its thickness "T" in the relaxed state. Conversely, as can be seen in the cross-sectional view taken in FIG. 1B, which represents the head support region 14, the pillow 10 in this region has a thickness "T" that is substantially greater than its width "W" in the relaxed state.

In some cases, it will be appreciated that the relative profile of the pillow 10 may change monotonically along its' length from the elongated first tapered edge 22 to the elongated second tapered edge 28. For example, the width "W" may smoothly and continuously decrease when moving from the elongated first tapered edge 22 to the elongated second tapered edge 28. Similarly, the thickness "T" may smoothly and continuously increase when moving from the elongated first tapered edge 22 to the elongated second tapered edge 28. In some cases, the width "W" and/or the thickness "T" may undergo one or more step-wise changes in dimension, or make a jagged transition.

The relatively wide profile shown in FIG. 1A may be considered as accommodating and supporting a person's upper torso thereon. The relatively vertical profile shown in FIG. 1B may be considered as accommodating and supporting the person's head. The person may sleep with their head on the left side of the pillow 10, engaging the first sheet 18, or the right side of the pillow 10, engaging the second sheet 20.

In some cases, the elongated first tapered edge 22 may include a seam 22*a* that represents the edge of the fabric sewn together in order to create the seam 22*a*. The elongated second tapered edge 28 may include a seam 28*a* that represents the edge of the fabric sewn together in order to create the seam 28*a*. In some cases, the seam 22*a* and/or the seam 28*a* may instead be replaced with a zipper that is sewn into the fabric and that can be opened in order to add, remove or adjust the fill and can be closed in order to hold the fill in the enclosure.

As seen in FIG. 2, which is an end view of the illustrative pillow 10, the elongated first tapered edge 22 may be considered as extending left to right within the plane of the paper while the elongated second tapered edge 28 may be considered as up and down and behind the plane of the paper. It will be appreciated that the head support region 14 may be considered as including a first head support region 50 on a left side 52 of the elongated second tapered edge 28 and a second head support region 54 on a right side 56 of the elongated second tapered edge 28. If a person is disposed on their stomach, in a prone position, the tapered torso support region 12 may extend in a forward direction relative to the plane of the paper, and may support a portion of the person's chest or upper torso. The person is able to rest their head on either the first head support region 50 or the second head support region 54, depending on which direction the person wishes to turn their head. If using the first head support region 50, the person would turn their head to the left, and the right side of their face or a portion thereof would be supported along the first head support region 50 to the left of the elongated second tapered edge 28. Conversely, if using the second head support region 54, the person would turn their head to the right, and the left side of their face or a portion thereof would be supported along the second head support region 54 to the right of the elongated second tapered edge 28. Of course, in this, reference to left and right refer to the person's left and right, rather than a viewpoint of an observer.

FIG. 3 is a side view of the illustrative pillow 10. The elongate first tapered edge 22 can be seen along a left side (in the illustrated orientation) of the pillow 10 while the elongated second tapered edge 28 can be seen along a right side (in the illustrated orientation) of the pillow 10. It will be appreciated that the elongated second tapered edge 28 is substantially perpendicular to the elongate first tapered edge 22 in the illustrative embodiment shown.

Figure 4:
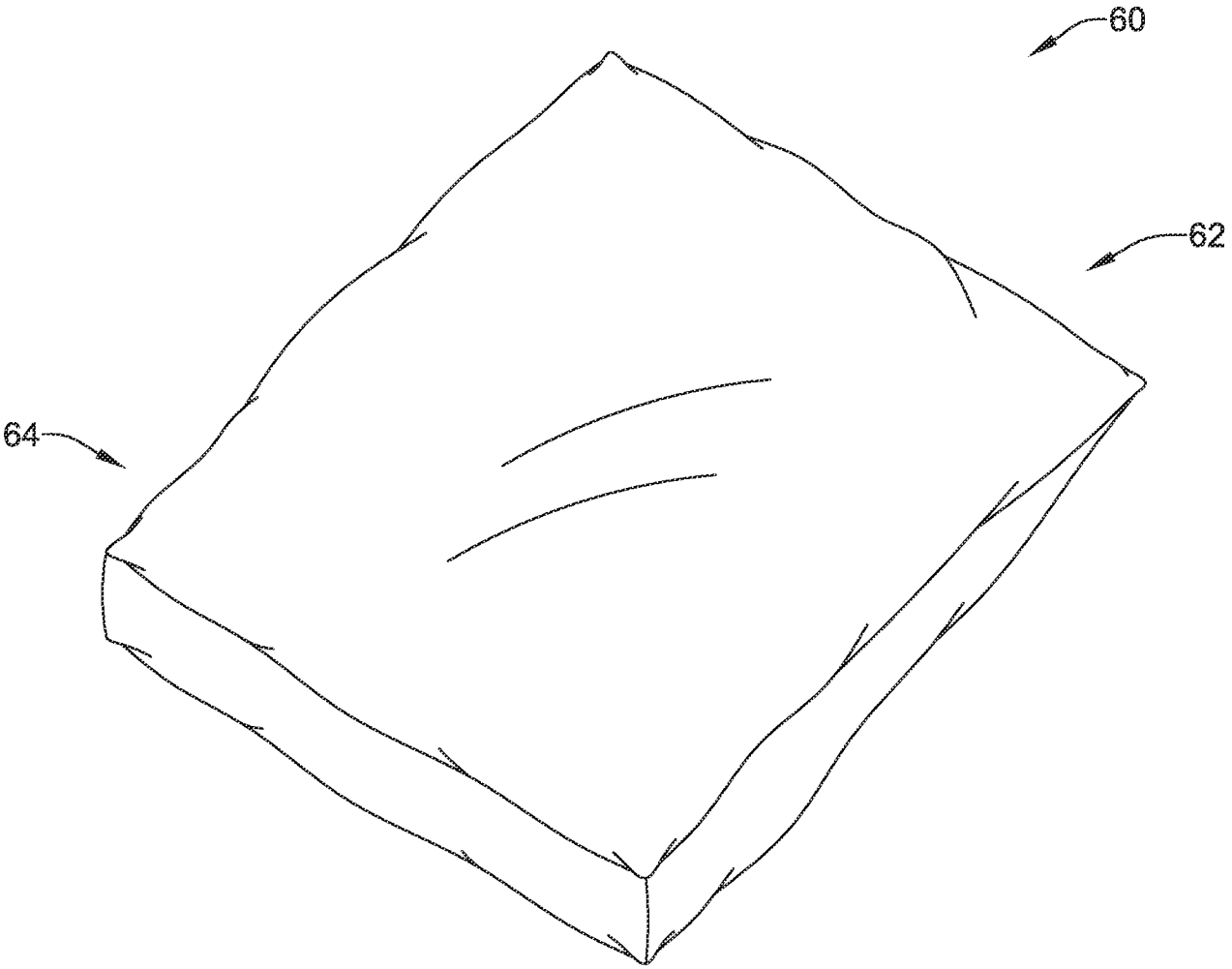
FIG. 4 is a perspective view of another illustrative pillow.
Figure 5:
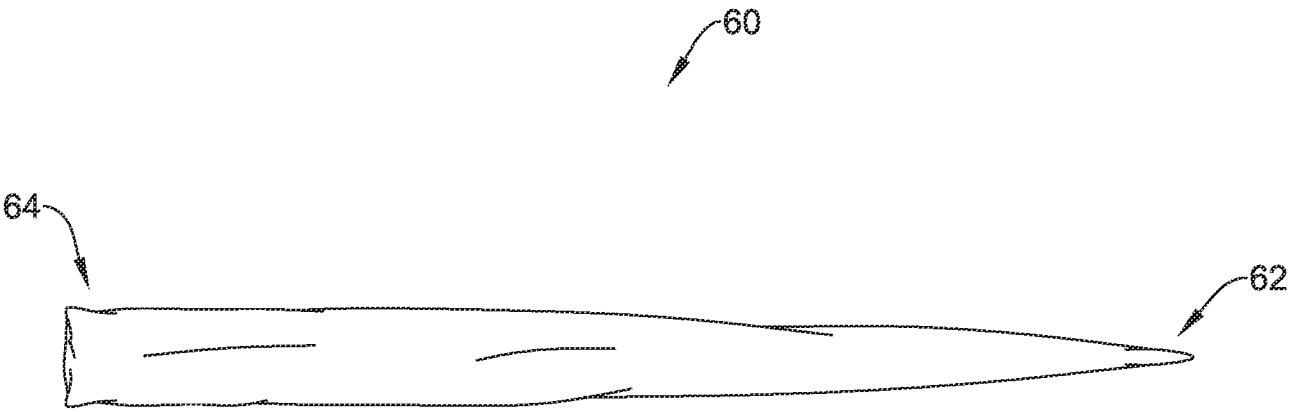
FIG. 5 is a side view of the illustrative pillow of FIG. 4.

FIG. 4 is a perspective view of an illustrative pillow 60 and FIG. 5 is a side view thereof. The illustrative pillow 60 includes a tapered end 62 and a box-shaped end 64. In some cases, the tapered end 62 may function as a torso support, much like the tapered torso support region 12 shown in FIGS. 1-3. In some cases, the pillow 60 may include a tapered end 62 at each end of the pillow 60. In some instances, the box-shaped end 64 may function as a head support, much like the head support region 14 shown in FIGS. 1-3. It will be appreciated that by placing the pillow 60 in position with the tapered end 62 underneath the sleeper's upper torso and the box-shaped end 64 proximate the sleeper's head, the pillow 60 functions to elevate the sleeper's head relative to their torso even when the sleeper is in a prone position. In some cases, the pillow 60 may include a fill much like that of the pillow 10. In some instances, the pillow 60 may include a unitary fill piece formed of foam such as polyurethane foam, that provides the illustrated shape to the pillow 60, but this is not required. Other fills are also contemplated, as further detailed herein. The pillow 60 may be dimensioned to ensure that the pillow 60 may be accommodated in any standard pillow case, but this is not required.

Figure 6:
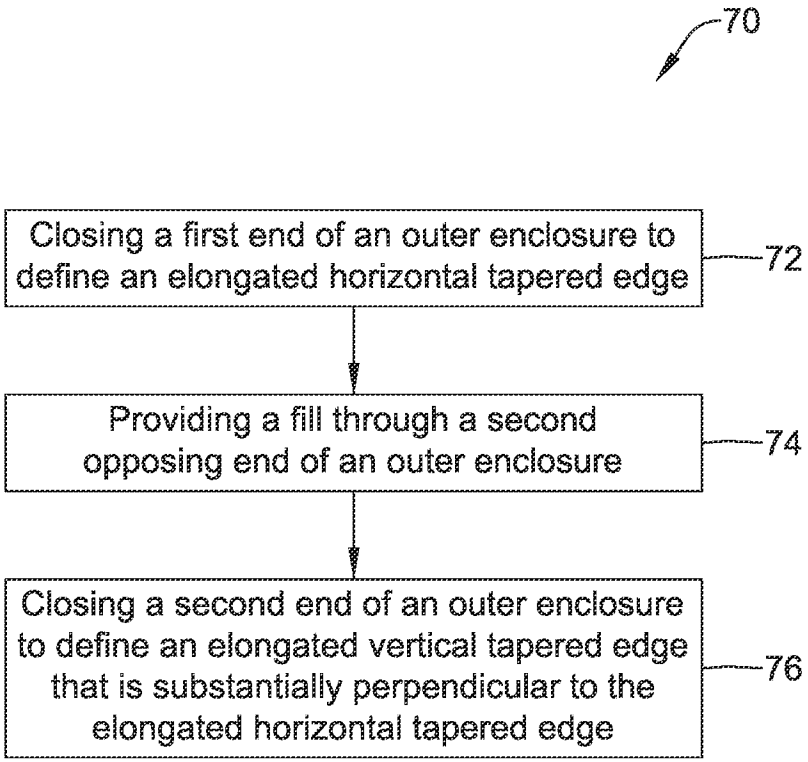
FIG. 6 is a flow diagram showing an illustrative method of making a pillow.

FIG. 6 is a flow diagram showing an illustrative method 70 for making a pillow such as the pillow 10 or the pillow 60. The illustrative method 70 includes closing a first end of an outer enclosure to define an elongated horizontal tapered edge, as shown in block 72. The elongated first tapered edge 22 (FIG. 1) is an example of an elongated horizontal tapered edge. A fill is provided through a second opposing end of the outer enclosure, as shown in block 74. The second end of the outer enclosure is closed to define an elongated vertical tapered edge that is substantially perpendicular to the elongated horizontal edge. This may include sewing a seam, or closing a zipper, for example. In some cases, substantially perpendicular may be defined as being, for example, within plus or minus 30 degrees from perpendicular, within plus or minus 20 degrees from perpendicular, within plus or minus 10 degrees from perpendicular, or within plus or minus 5 degrees from perpendicular. These are just examples. The elongated second tapered edge 28 (FIG. 1) is an example of an elongated vertical tapered edge.

Figure 7:
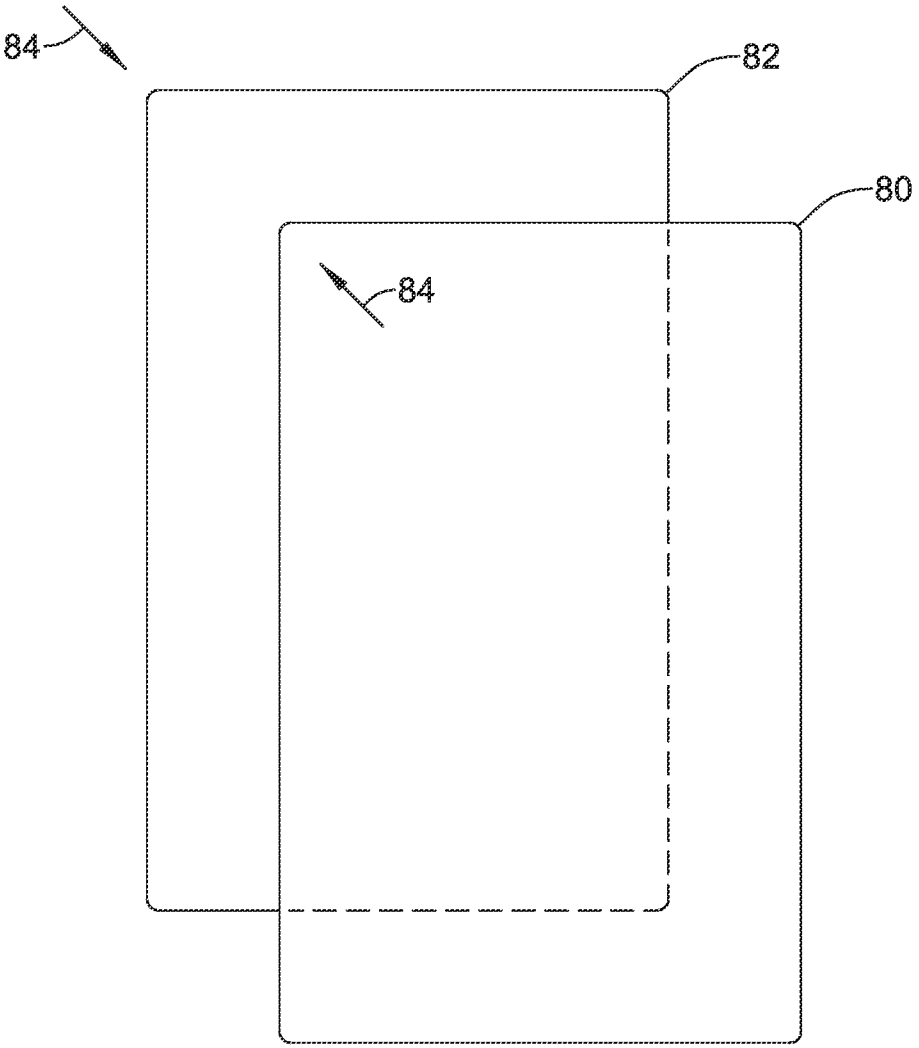
FIGS. 7 through 10 are schematic views showing a method of making the illustrative pillow of FIG. 1.
Figure 8:
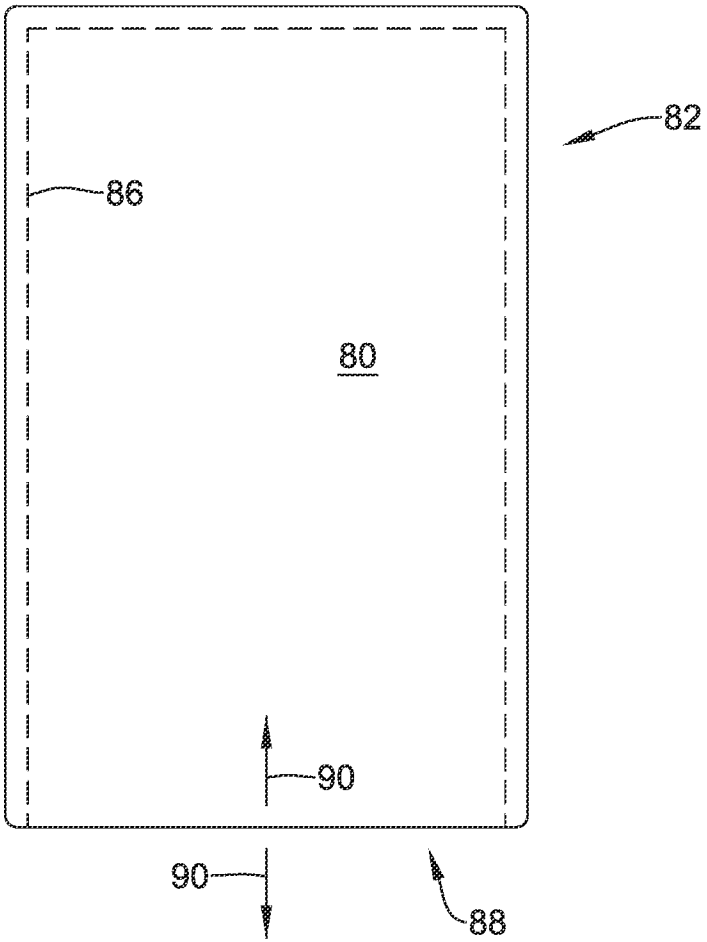

FIGS. 7 through 10 are schematic drawings illustrating a method of making a pillow such as the pillow 10 or the pillow 60. In FIG. 7, a top sheet 80 may be brought into position relative to a bottom sheet 82, as indicated by arrows 84. In this example, the top sheet 80 and the bottom sheet 82 are separate pieces of fabric. In some cases, however, the top sheet 80 and the bottom sheet 82 may be formed by folding a common sheet in half. In FIG. 8, it can be seen that the top sheet 80 and the bottom sheet 82 have been joined together along three sides via stitching 86, leaving an open end 88. It will be appreciated that by comparing with FIG. 1, the stitching 86 may form the first side seam 34 and the second side seam 36. The stitching 86 may also be considered as forming the elongated first tapered edge 22, which would be at the end opposing the open end 88.

Figure 9:
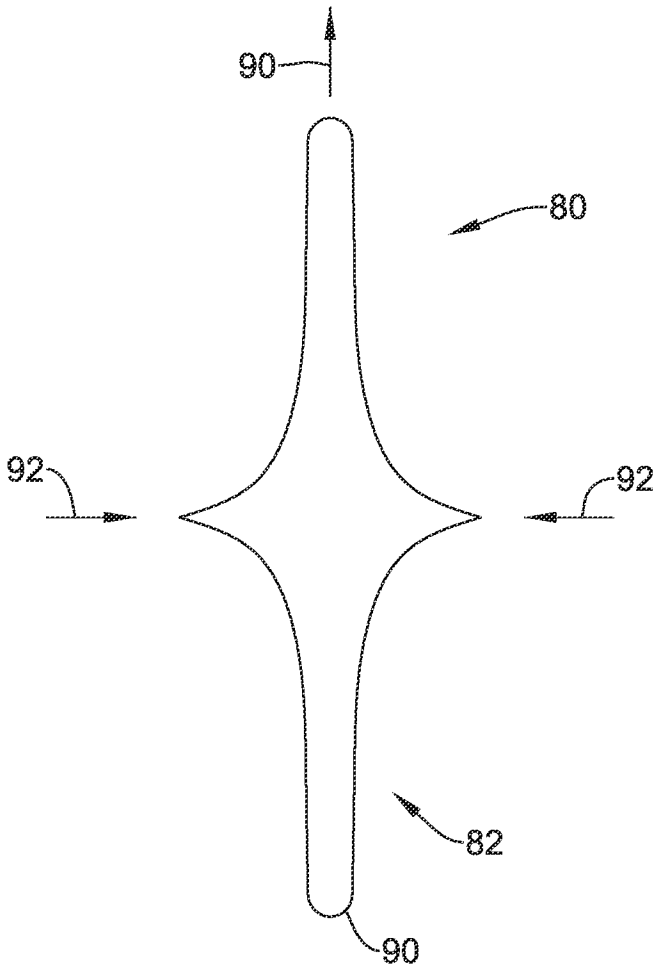
Figure 10:
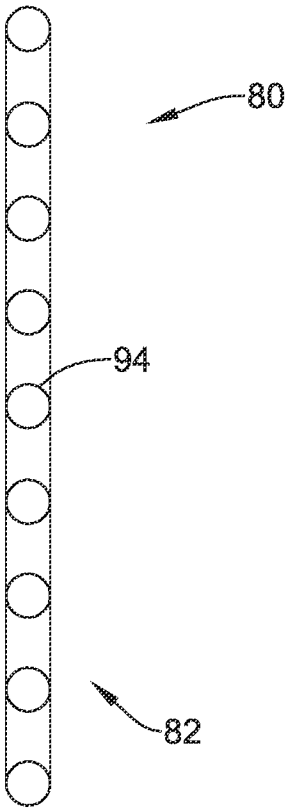

To close the open end 88, the end of the top sheet 80 near the open end 88 and the end of the bottom sheet 82 near the open end 88 may be grasped and pulled apart, as indicated by the arrows 90 in FIG. 8. The resulting shape is shown in FIG. 9, where the top sheet 80 forms the top half and the bottom sheet 82 forms the bottom half. The open end 88 can then be sewn shut via stitching 94 as seen in FIG. 10. In some cases, rather than simply sewing the open end 88 shut, a zipper may be added to the open end 88. This may entail sewing a first edge of the zipper to an edge of the top sheet 80 and sewing a second edge of the zipper to an edge of the bottom sheet 82. It will be appreciated that a zipper typically has an elongate sewing panel extending along either side of the zipper itself.

In some cases, the stitching 86 and/or the stitching 94 may occur while the top sheet 80 (or the top sheet half of a folded common sheet) and the bottom sheet 82 (or the bottom sheet half of a folded common sheet) are inside out. This provides a nice, clean look and finish to the resulting pillow. In some cases, a small gap is left somewhere in either the stitching 86 or the stitching 94 in order for the pillow enclosure to be turned right side out, followed by adding the fill to the pillow enclosure. Once the fill has been added, the small gap through which the fill was added can be sewn shut.

Figure 11:
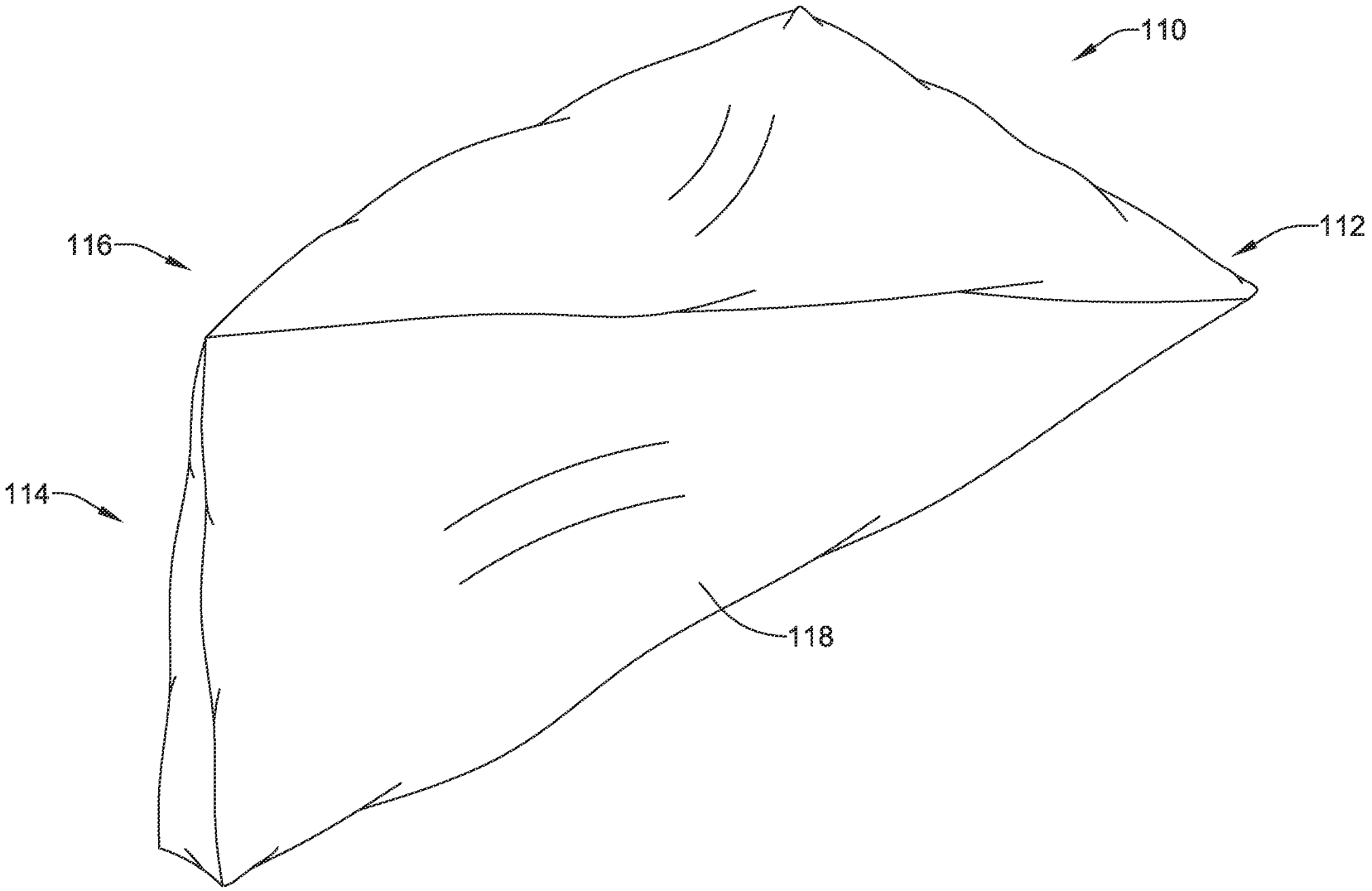
FIG. 11 is a perspective view of another illustrative pillow.

FIG. 11 is a perspective view of an illustrative pillow 110. The illustrative pillow 110 includes a tapered end 112 and a triangle-shaped end 114. In some cases, the tapered end 112 may function as a torso support, much like the tapered torso support region 12 shown in FIGS. 1-3. In some instances, the triangle-shaped end 114 may function as a head support, much like the head support region 14 shown in FIGS. 1-3. In some cases, the pillow 110 may have a triangle-shaped end 114 at each end of the pillow 110. It will be appreciated that the triangle-shaped end 114 includes tapered sides 116 and 118, which may function to accommodate a sleeper's head, depending on which direction they turn their head, and thus whether they rest the right side of their face on the tapered side 116 or the left side of their face on the tapered side 118.

In some cases, the pillow 110 may include a fill much like that of the pillow 10. In some instances, the pillow 110 may include a unitary fill piece formed of foam such as polyurethane foam, that provides the illustrated shape to the pillow 110. Other fills are also contemplated, as further detailed herein. The pillow 110 may be dimensioned to ensure that the pillow 110 may be accommodated in any standard pillow case, for example.

Figure 12:
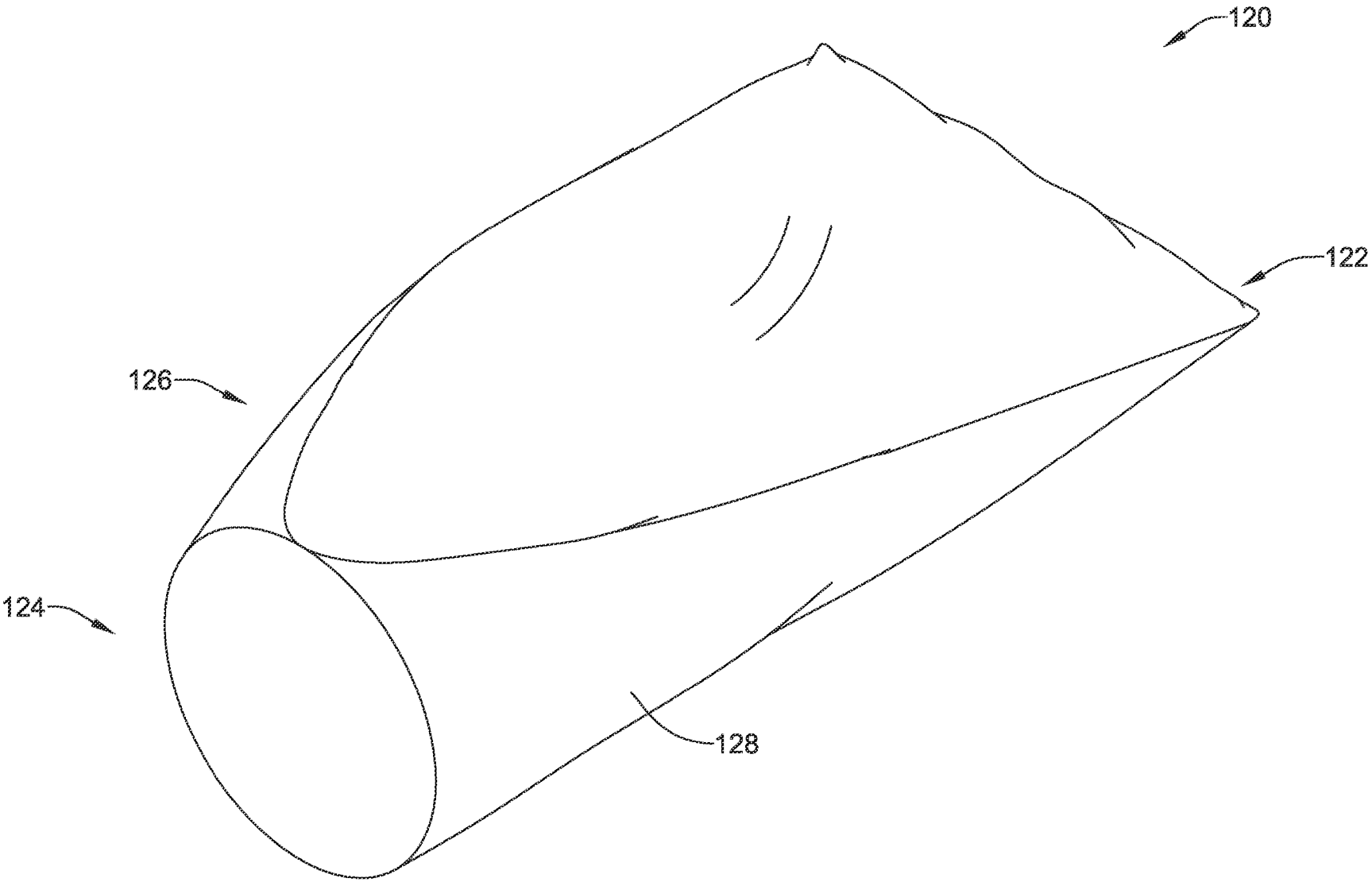
FIG. 12 is a perspective view of another illustrative pillow.

FIG. 12 is a perspective view of an illustrative pillow 120. The illustrative pillow 120 includes a tapered end 122 and a circular-shaped end 124. In some cases, the tapered end 122 may function as a torso support, much like the tapered torso support region 12 shown in FIGS. 1-3. In some instances, the circular-shaped end 124 may function as a head support, much like the head support region 14 shown in FIGS. 1-3. In some cases, the pillow 120 may have a circular-shaped end 124 at each end of the pillow 120. It will be appreciated that the circular-shaped end 124 includes tapered or curved sides 126 and 128, which may function to accommodate a sleeper's head, depending on which direction they turn their head, and thus whether they rest the right side of their face on the tapered or curved side 126 or the left side of their face on the tapered or curved side 128.

In some cases, the pillow 120 may include a fill much like that of the pillow 10. In some instances, the pillow 120 may include a unitary fill piece formed of foam such as polyurethane foam, that provides the illustrated shape to the pillow 120. Other fills are also contemplated, as further detailed herein. The pillow 120 may be dimensioned to ensure that the pillow 120 may be accommodated in any standard pillow case, for example.

Figure 13:
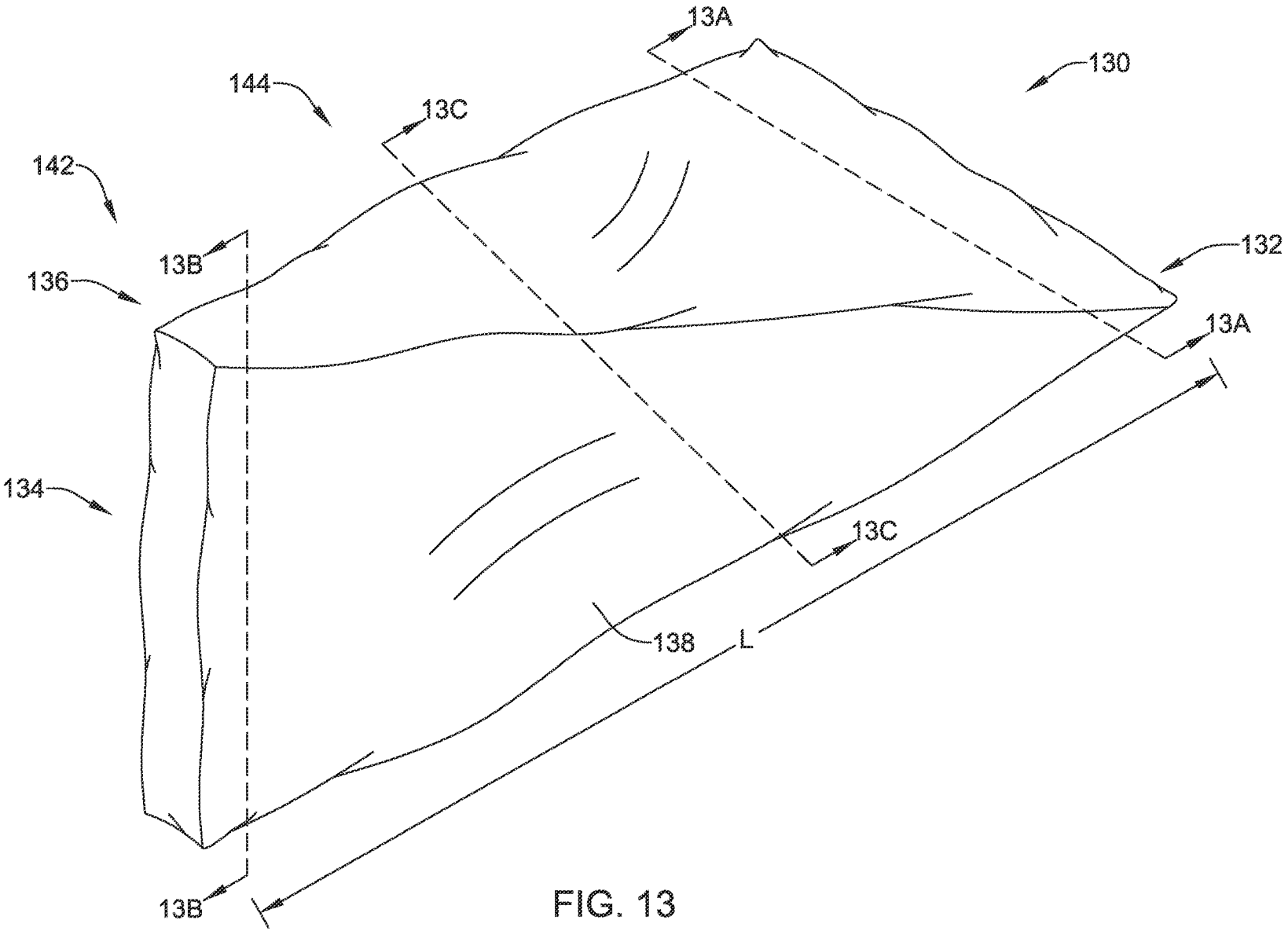
FIG. 13 is a perspective view of another illustrative pillow

FIG. 13 is a perspective view of an illustrative pillow 130. The illustrative pillow 130 includes a tapered end 132 and a blunted or box-shaped end 134. The pillow 130 has a length "L" extending from the tapered end 132 to the box-shaped end 134. In some cases, the tapered end 132 may function as a torso support, much the like the tapered torso support region 12 shown in FIGS. 1-3. In some instances, the box-shaped end 134 may function as a head support, much like the head support region 14 shown in FIGS. 1-3. In some cases, the pillow 130 may include a box-shaped end 134 at both ends of the pillow 130. It will be appreciated that the box-shaped end 134 includes tapered sides 136 and 138, which may function to accommodate a sleeper's head, depending on which direction they turn their head, and thus whether they rest the right side of their face on the tapered side 136 or the left side of their face on the tapered side 138.

Figure 13B:
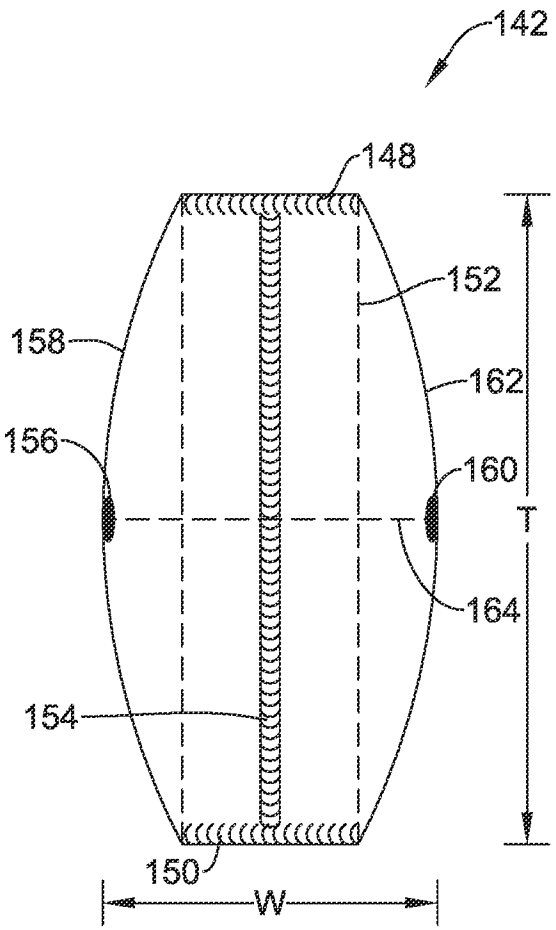
FIG. 13B is a cross-sectional view taken along the line 13B-13B of FIG. 13 looking toward an opposing second end of the pillow.
Figure 13A:
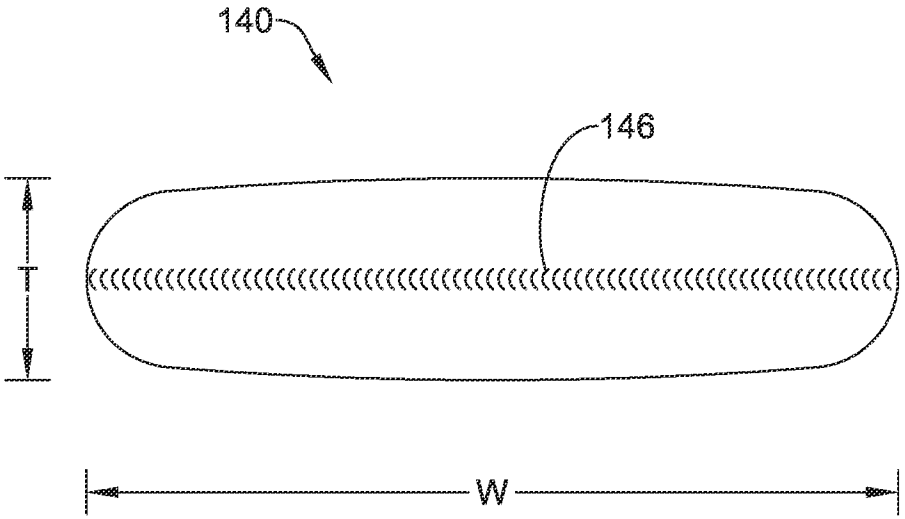
FIG. 13A is a cross-sectional view taken along the line 13A-13A of FIG. 13 looking toward a first end of the pillow.
Figure 13C:
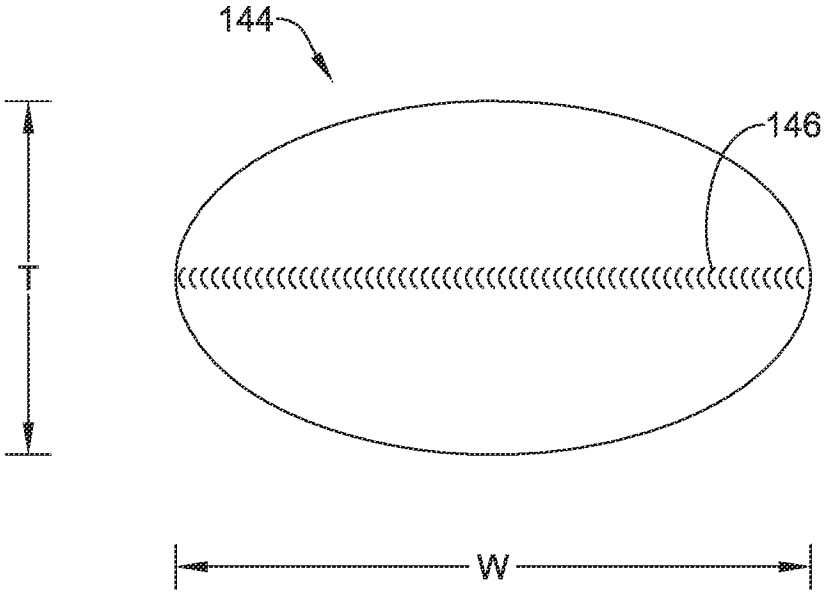
FIG. 13C is a cross-sectional view taken along the line 13C-13C of FIG. 13 looking toward the first end of the pillow.

FIG. 13A is a cross-sectional view of the pillow 130, taken along the line 13A-13A of FIG. 13 and illustrating a profile of the pillow 130 within a torso support region 140. FIG. 13B is a cross-sectional view of the pillow 130, taken along the line 13B-13B of FIG. 13 and illustrating a blunted or box-end head support region 142. FIG. 13C is a cross-sectional view of the pillow 130, taken along the line 13C-13C of FIG. 13 and illustrating an intermediate region 144 of the pillow 130. In FIGS. 13A, 13B and 13C, the fill has been removed.

Taken together, these cross-sectional views help illustrate how the pillow 130 provides the torso support region 140 that may be considered as having more of a horizontal orientation and the head support region 142 that may be considered as having more of a vertical orientation. It will be appreciated that the exact shape of these two cross-sectional views should be considered as being representative of the pillow 130 in a relaxed state, as the exact shape will depend on the fill that is placed within the pillow 130 and on external forces exerted on the pillow 130.

The illustrative pillow 130 has a width "W" and a thickness "T". In this, width may be considered as a dimension across the end of the pillow 130 that is parallel or substantially parallel with a surface on which the pillow 130 will be used, such as on a bed. Thickness may be considered as a dimension that is perpendicular or substantially perpendicular to the width, and perpendicular or substantially perpendicular to the surface on which the pillow 130 will be used. Width "W" and length "L" may be considered as both being perpendicular to the length "L" of the pillow 130. As can be seen in the cross-sectional view shown in FIG. 13A, which represents the torso support region 140, the pillow 130 in this region has a width "W" that is substantially greater than its thickness "T" in the relaxed state. Conversely, as can be seen in the cross-sectional view taken in FIG. 13B, which represents the head support region 142, the pillow 130 in this region has a thickness "T" that is substantially greater than its width "W" in the relaxed state.

In some cases, it will be appreciated that the relative profile of the pillow 130 may change monotonically along its' length from the torso support region 140 to the head support region 142. For example, the width "W" may smoothly and continuously decrease when moving from the torso support region 140 to the head support region 142. Similarly, the thickness "T" may smoothly and continuously increase when moving from the torso support region 140 to the head support region 142. This can be seen in FIG. 13C, which shows the intermediate region 144, which is located between the torso support region 140 and the head support region 142. In comparing the intermediate region 144 to the tapered end 132 and to the box-shaped end 134, it can be seen that the intermediate region 144 has a width "W" that is intermediate the width "W" shown in the tapered end 132 and the width "W" shown in the box-shaped end 134. Similarly, it can be seen that the intermediate region 144 has a thickness "T" that is intermediate the thickness "T" shown in the tapered end 132 and the thickness "T" shown in the box-shaped region 134. In some cases, the width "W" and/or the thickness "T" may instead undergo one or more stepwise changes in dimension, or make a jagged transition.

In some cases, and with particular reference to FIG. 13A, the torso support region 140 may include a stitched seam 146 that extends laterally across and end of the torso support region 140. In some cases, a zipper (not shown) may be sewn into the end of the torso support region 140.

In some cases, and with particular reference to FIG. 13B, the head support region 142 may have a box-shaped profile that is created by sewing a pair of wings 148 and 150. The wing 148 may be sewn into the pillow 130 at an upper edge of a "box" 152 and the wing 150 may be sewn into the pillow 130 at a lower edge of the "box" 152. The wings 148 and 150 help to define a box-shape to the head support region 142.

In some instances, the head support region 142 may include a zipper 154 that extends from near the wing 148 to near the wing 150. The zipper 154 may be configured to allow a user to unzip the zipper 154 in order to add fill to the pillow 130, to remove fill from the pillow 130 or to otherwise adjust the fill within the pillow 130. The zipper 154 can be zipped shut in order to keep the fill within the pillow 130. While a zipper 154 is illustrated, it will be appreciated that other methods of closure may be used. For example, the head support region 142 may include a number of ties that can be tied or untied, as desired. In some cases, instead of the zipper 154, hook and loop fasteners, commonly available under the VELCRO™ tradename, may be used. These are just examples.

The pillows 10, 60, 110, 120, 130 described herein are each described as having a particular first end and a particular second end. In some cases, a pillow 10, 60, 110, 120, 130 may include a first end as shown with respect to one of the pillows 10, 60, 110, 120, 130 and may have a second end as shown with respect to another of the pillows 10, 60, 110, 120, 130. In other words, in some cases the pillow ends may be mixed and matched. A pillow may have a box-shaped end at one end of the pillow and a flat, round, or even triangular-shaped end at the other end of the pillow, for example.

FIG. 13B shows another possible feature of the pillow 130. In some cases, the pillow 130 may include internal structure that helps to limit how far the pillow 130 can deformed. It will be appreciated that a pillow 130 can generally be deformed into shapes or configurations substantially different from the shape or configuration that is intended for the pillow 130. In the example shown, the pillow 130 may include a first anchor 156 that is disposed within the pillow 130 at or near a side wall 158 and a second anchor 160 that is disposed within the pillow 130 at or near a side wall 162 of the pillow 130. An elongate member 164 extends between the first anchor 156 and the second anchor 160 to limits how far apart the side wall 158 and the side wall 162 move away from each other when the pillow 130 is deformed by a user.

In some cases, the first anchor 156 and the second anchor 160 may each be buttons that are sewn onto an interior side of the side walls 158 and 162, respectively. In some cases, the elongate member 164 may be an elastic member that stretches between the first anchor 156 and the second anchor 160. In some cases, the elongate member 164 may be or include a non-elastic member. While the anchors 156, 160 and elongate member 164 are illustrated as extending between the side walls 158 and 162 of the head support region 142, it will be appreciated that this is merely illustrative, and similar structures may be used in other positions within the pillow 130.

In some cases, the pillow 130 may include a fill much like that of the pillow 10. In some instances, the pillow 130 may include a unitary fill piece formed of foam such as polyurethane foam, that provides the illustrated shape to the pillow 130. Other fills are also contemplated, as further detailed herein. The pillow 130 may be dimensioned to ensure that the pillow 130 may be accommodated in any standard pillow case, but this is not required.

The pillow 10, 60, 110, 120, 130 may include any of a variety of different types of fill. For example, the pillow 10, 60, 110, 120, 130 may include a fill that includes one or more of down, feathers, polyester fiberfill, shredded memory foam, buckwheat hulls, microbeads, shredded latex, Kapok, wool, cotton and down alternatives. Each of these have pluses and minuses, and an optimal pillow fill for one person may not be the same as the optimal pillow fill for another person. Down tends to hold its shape well, is light, durable and sustainable. Unfortunately, down tends to be expensive and some people can be allergic to down. Feather filling may be considered as a less expensive version of down, although feather filling needs frequent fluffing. Polyester fiberfill, available commercially as Poly-Fil is very inexpensive, easy to clean and is lightweight. Poly-Fil is commercially available in a variety of different weights. Shredded memory foam does not clump and provides good support, but can soften upon application of body heat.

Buckwheat hulls are viewed as providing good support and are breathable with a long life-span, but can be considered as heaving, and can make a rustling noise when shifted. Microbeads may be considered as a synthetic alternative to buckwheat hulls. Microbeads are breathable and moldable, but have a shorter life span. Shredded latex is breathable and moldable, but can be expensive and can have a rubbery odor. Kapok comes from a tropical tree native to Mexico and is free of potentially toxic materials. However, Kapok does not hold shape very well and is extremely flammable. Wool is breathable, but can become lumpy. Cotton is odorless and breathable, but does not hold shape well and can become lumpy. Down alternatives are synthetic replacements for down and are much less expensive than down, but often do not hold up well.

In some cases, the pillow fill includes a plurality of polyurethane foam pieces including a first plurality of foam pieces of a first average size, a second plurality of foam pieces of a second average size, and a third plurality of foam pieces of a third average size, with the first, second, and third average sizes being different, and with the first, second, and third pluralities of foam pieces disposed in the outer enclosure in a mix, with the first plurality of foam pieces representing approximately 20 to 30 percent of the plurality of polyurethane foam pieces, and with the second plurality of foam pieces and the third plurality foam pieces constituting the remaining foam disposed in the outer enclosure, in an approximately equal proportion by volume.

In some cases, the pillow fill may include a combination of two or more types of fills. For example, the pillow fill may include a combination of polyester fiberfill and foam pieces. In some cases, the foam pieces may be polyurethane foam pieces, but other polymers are also contemplated. In some cases, the pillow fill may range from about 10 weight percent polyester fiberfill and about 90 weight percent foam pieces, or about 20 weight percent polyester fiberfill and about 80 weight percent foam pieces, or about 30 weight percent polyester fiberfill and about 70 weight percent foam pieces, or about 40 weight percent polyester fiberfill and about 60 weight percent foam pieces, or about 50 weight percent polyester fiberfill and about 50 weight percent foam pieces, or about 60 weight percent polyester fiberfill and about 40 weight percent foam pieces, or about 70 weight percent polyester fiberfill and about 30 weight percent foam pieces, or about 80 weight percent polyester fiberfill and about 20 volume percent foam pieces, or about 90 weight percent polyester fiberfill and about 10 weight percent foam pieces.

In some cases, polyurethane foams such as open cell foams and closed cell foams may be used. Polyurethane foams may be naturally hypoallergenic, or may be treated to make them hypoallergenic. The polyurethane foam pieces used as pillow fill may, for example, include a first plurality of foam pieces, such as foam pieces. A second plurality of foam pieces are, on average, smaller in size than those of the first plurality of foam pieces such that at least some of the second plurality of foam pieces fit into at least some of the interstices formed within the first plurality of foam pieces. A third plurality of foam pieces are, on average, smaller in size than those of the second plurality of foam pieces such that at least some of the third plurality of foam pieces may fit into at least some of the interstices formed within the second plurality of foam pieces.

In some cases, the polyurethane foam pieces may have a density of from about 1.8 pounds per cubic foot to about 1.9 pounds per cubic foot. In some cases, foam having an indent force deflection at 25% of from about 27 to about 35 may be used. Foams having a compressive set percentage of approximately 10 percent may be used. In some instances, foam having a tensile strength of approximately 10 pounds per square inch may be used. Foams having a tear strength of approximately 1 pound per linear inch may be used. Foams having an elongation percentage of 100 percent may be used. Foams having other or additional mechanical properties also fall within the present specification. Foam properties may be established using the ASTM D-3574-86 test method.

Having thus described several illustrative embodiments of the present disclosure, those of skill in the art will readily appreciate that yet other embodiments may be made and used within the scope of the claims hereto attached. It will be understood, however, that this disclosure is, in many respects, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A pillow comprising:

a first pillow end;

a second pillow end opposite to the first pillow end;

a pillow length extending between the first pillow end and the second pillow end;

a pillow width perpendicular to the pillow length;

a pillow thickness perpendicular to the pillow length and perpendicular to the pillow width;

wherein the pillow width is greater than the pillow thickness at the first pillow end and the pillow thickness is greater than the pillow width at the second pillow end;

wherein the pillow width decreases in a monotonically decreasing trend from the pillow width of the first pillow end to the pillow width of the second pillow end; and wherein the pillow thickness increases in a monotonically increasing trend from the pillow thickness of the first pillow end to the pillow thickness of the second pillow end.

2. The pillow of claim 1, further comprising:

an intermediate pillow region between a first pillow end region that includes the first pillow end and a second pillow end region that includes the second pillow end, wherein the pillow width and the pillow thickness in the intermediate pillow region transitions from the pillow width and the pillow thickness at the first pillow end region to the pillow width and the pillow thickness at the second pillow end region.

3. The pillow of claim 2, wherein the first pillow end region is configured to provide a tapered torso support region, and the second pillow end region is configured to provide a first head support region on a left side of the second pillow end region and a second head support region on a right side of the second pillow end region.

4. The pillow of claim 2, wherein the first pillow end region is more tapered to the first pillow end than the second pillow end region is to the second pillow end.

5. The pillow of claim 4, wherein the second pillow end region is blunted at the second pillow end.

* * * * *